United States Patent [19]

Ohm

[11] 4,355,314

[45] Oct. 19, 1982

[54] WIDE-FIELD-OF-VIEW ANTENNA ARRANGEMENT

[75] Inventor: Edward A. Ohm, Holmdel, N.J.

[73] Assignee: Bell Telephone Laboratories, Incorporated, Murray Hill, N.J.

[21] Appl. No.: 211,104

[22] Filed: Nov. 28, 1980

[51] Int. Cl.[3] ..... H01Q 19/19

[52] U.S. Cl. ..... 343/779; 343/781 CA

[58] Field of Search ..... 343/779, 781 P, 781 CA, 343/836

[56] References Cited

U.S. PATENT DOCUMENTS

| | | | |
|---|---|---|---|
| 2,295,136 | 12/1966 | Miller | 343/781 |
| 2,975,419 | 3/1961 | Brown | 343/754 |
| 3,696,435 | 10/1972 | Zucker | 343/779 |
| 3,761,935 | 9/1973 | Silbiger et al. | 343/754 |
| 3,914,768 | 10/1975 | Ohm | 343/779 |
| 3,922,682 | 11/1975 | Hyde | 343/761 |
| 3,953,858 | 4/1976 | Ohm | 343/779 |
| 3,983,560 | 9/1976 | MacDougall | 343/781 |
| 4,062,018 | 12/1977 | Yokoi et al. | 343/754 |
| 4,070,678 | 1/1978 | Smedes | 343/754 |
| 4,145,695 | 3/1979 | Gans | 343/779 |
| 4,203,105 | 5/1980 | Dragone et al. | 343/779 |

OTHER PUBLICATIONS

Dragone, Imaging Reflector Arrangements to form a Scanning Beam, Bell System Technical Journal, vol. 58, No. 2, pp. 501–515, 2–79.

Mizugutchi, Offset Dual Reflector Antenna, IEEE 1976 AP-S Int. Symp., pp. 2–5, 10–76.

Mizuguchi et al., Offset Gregorian Antenna, Trans. of IECE of Japan, vol. E61, No. 3, pp. 248–249, 3–78.

Tong et al., Evaluation of Beam-Scanning Dual-Reflector Antennas, Proc. IEEE, vol. 124, No. 12, pp. 1111–1113, 12–77.

Long et al., Exp. Study of Scanning Char. of Cass. Reflector Antenna, IEEE AP-S Int. Symp., pp. 545–548, 6–77.

Dragone, Offset Multireflector Antennas with Perfect Pattern Symmetry, Bell System Tech. Journal, vol. 57, No. 7, pp. 2663–2684, 9–78.

*Primary Examiner*—Eli Lieberman

*Attorney, Agent, or Firm*—Erwin W. Pfeifle

[57] ABSTRACT

The present invention relates to a wide-field-of-view antenna arrangement which permits the angular range over which multiple beams may be transmitted or received to be increased by taking into consideration the location of the tangential and sagittal focal regions associated with multibeam systems. The subreflector (18,24) is positioned relative to the main reflector (10,20) such that the tangential and sagittal focal regions lie behind the subreflector of a Cassegrainian arrangement, or alternatively in front of the subreflector of a Gregorian arrangement for a predetermined wide-field-of-view.

3 Claims, 7 Drawing Figures

WIDE-FIELD-OF-VIEW ANTENNA ARRANGEMENT

BACKGROUND OF THE INVENTION

1. Field of the Invention

The present invention relates to a wide-field-of-view antenna arrangement, and more particularly, to an antenna arrangement which permits the angular range over which multiple beams may be transmitted or received to be increased over prior art designs by locating a subreflector in relation to the main reflector such that the sagittal and tangential focal regions of the main reflector associated with each beam employed in a multibeam wide-field-of-view system lie behind the reflecting surface of a Cassegrainian subreflector, or in front of the reflecting surface of a Gregorian subreflector.

2. Description of the Prior Art

In many applications, reflectors will generate aberrations in a wavefront reflected therefrom. This is especially true in a multibeam reflector antenna system. Antenna systems, however, have been previously devised to correct for certain aberrations which have been found to exist.

One antenna design which compensates for second order aberrations is disclosed in U.S. Pat. No. 3,696,435 issued to H. Zucker on Oct. 3, 1972. In accordance with Zucker, two or more beams of an offset parabolic reflector antenna are directed without producing second order aberrations by placing their respective feeds so that their phase centers reside at mathematically defined locations with respect to the reflector. In particular, multiple main beams having substantially zero second order aberrations are achieved by locating two or more feeds so that their phase centers reside substantially in a plane on a curved line unique to the particular reflector.

A method for correcting other aberrations is to include a corrector lens in the antenna assembly, as disclosed, for example, in U.S. Pat. No. 3,761,935 issued to R. J. Silbiger et al on Sept. 25, 1973. The lens is curved in such a way as to compensate for defocusing, which otherwise occurs in the antenna in the absence of the lens. As alleged in Silbiger et al, the addition of the corrector lens makes it possible to accomplish substantially distortionless scanning in an angular range, with an array of a given size, which heretofore could only be accomplished by an array of at least twice the size.

Correction of spherical aberration can be achieved by altering the shape of the subreflector employed in an antenna system, as disclosed in U.S. Pat. No. 3,922,682 issued to G. Hyde on Nov. 25, 1975, which relates to an antenna system including a toroidal reflector wherein the specific shape of the subreflector ultimately depends on the geometry of the toroidal reflector. The design of the subreflector's reflecting surface is accomplished by developing a geometric optics model of the focusing properties of the toroidal reflector and using a computer to generate the subreflector shape by numerically computing points on the surface of the subreflector for separate, individual rays intercepted by the toroidal reflector. These points may then be used to machine the subreflector surface using numerically controlled milling machines. The Hyde subreflector, however, only corrects for aberrations of the torus for one beam direction at a time (similar to correction of spherical aberration). That is, a separate subreflector is needed for each beam, thereby resulting in wide spacing of adjacent beams. Furthermore, the torus requires substantial enlargement of the main reflector to achieve a wide-field-of-view.

A technique for overcoming the aberration of astigmatism is modification of a feed design, as disclosed in U.S. Pat. No. 4,145,695 issued to M. J. Gans on Mar. 20, 1979. There, astigmatism is corrected by using with each off-axis feedhorn, an astigmatic launcher reflector having a curvature and orientation chosen in accordance with a particular relationship to substantially correct for astigmatism introduced in the waveform radiated and/or received in the off-axis direction.

It is well known that the dominant aberrations of both an offset Cassegrainian antenna and an offset Gregorian antenna, are astigmatism and coma. It is also well known from principles of geometric optics that the aberration of coma, which is introduced in off-axis directions by the antenna reflectors, increases with an increase in the angle at which beams are incident upon the main reflector. Furthermore, the tangential and sagittal focal regions associated with astigmatism shift in location as the off-axis angle is increased. Since astigmatism can be corrected by other means, the remaining problem is to provide apparatus for the correction of coma in wide-field-of-view off-axis-fed reflector antennas. The method outlined here takes into consideration the location of the above-mentioned astigmatic focal regions.

SUMMARY OF THE INVENTION

The problem remaining in the prior art has been solved in accordance with the present invention, which relates to a wide-field-of-view antenna arrangement and more particularly, to an antenna arrangement which permits the angular range over which multiple beams may be transmitted or received to be increased over prior art designs by locating a subreflector in relation to the main reflector such that the sagittal and tangential focal regions of the main reflector associated with each beam employed in a multibeam wide-field-of-view system lie behind the reflecting surface of a Cassegrainian subreflector, or in front of the reflecting surface of a Gregorian subreflector.

In accordance with the present invention, the subreflector is positioned in relation to the main reflector so that the tangential and sagittal focal regions either remain behind the reflecting surface of the subreflector of an offset Cassegrainian arrangement, or in front of the reflecting surface of the subreflector of an offset Gregorian arrangement as the field-of-view of the antenna system is increased. Therefore, since both focal regions remain virtual in a Cassegrainian arrangement or real in a Gregorian arrangement, beams as far off the central axis of the main reflector as, for example but not limited to, 25 degrees, will converge upon reflection from the subreflector, where in the prior art, far off-axis beams in a Cassegrainian arrangement become divergent when one of the focal regions intersects the reflecting surface of the subreflector, or far off-axis beams in a Gregorian arrangement become extremely convergent, and hence impractical, when one of the focal regions intersects the reflecting surface of the subreflector.

Other and further aspects of the present invention will become apparent during the course of the following description and by reference to the accompanying drawings.

DETAILED DESCRIPTION

Figure 1:
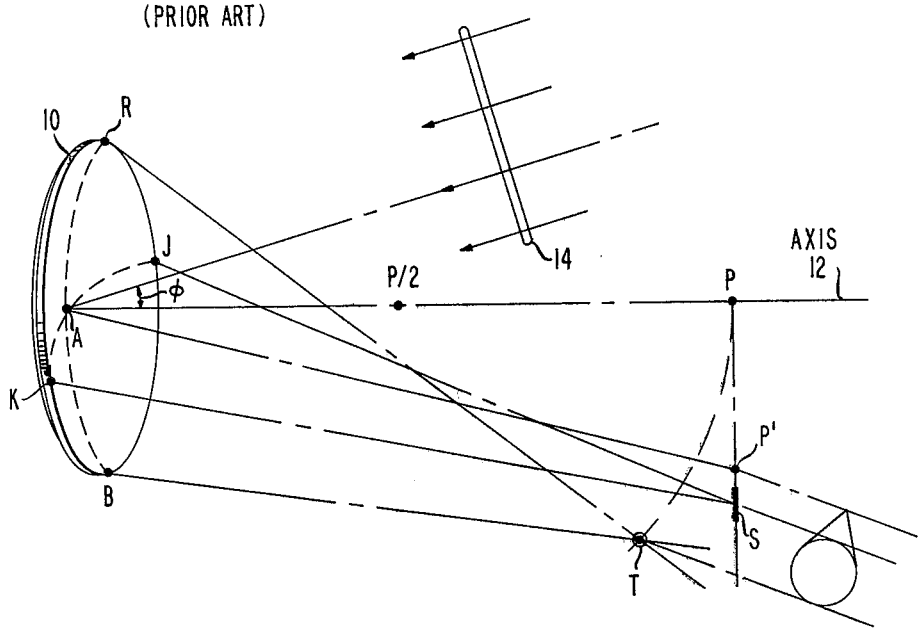
FIG. 1 (PRIOR ART)
FIG. 1 contains a view in perspective of the formation of the sagittal and tangential focal regions illustrating the astigmatic and coma aberrations associated with a single off-axis beam which is incident upon a spherical reflecting surface.

When a parallel beam wavefront forms an appreciable angle Φ with the boresight axis of an antenna's main reflector, the result is that instead of a point image, two image regions denoted sagittal (S) and tangential (T) are formed. As illustrated in FIG. 1, the incoming rays forming beam 14 are parallel as they strike a spherical reflector 10, while the reflected rays converge toward the tangential and sagittal focal regions.

In particular, the rays of beam 14 which reflect from points K and J of reflector 10, referred to as sagittal rays, come to a focus in the S focal region, while the rays of beam 14 which reflect from points R and S of reflector 10, referred to as tangential rays, come to a focus in the T focal region. The off-axis focal point if astigmatism is zero, denoted as P' in FIG. 1, is associated with the chief ray of beam 14 and reflects from point A of reflector 10. Due to astigmatism inherent in reflector 10, the P', S and T focal regions do not coincide. The conventional comatic figure shown at the right of FIG. 1 arises only in the absence of astigmatism.

Figure 2:
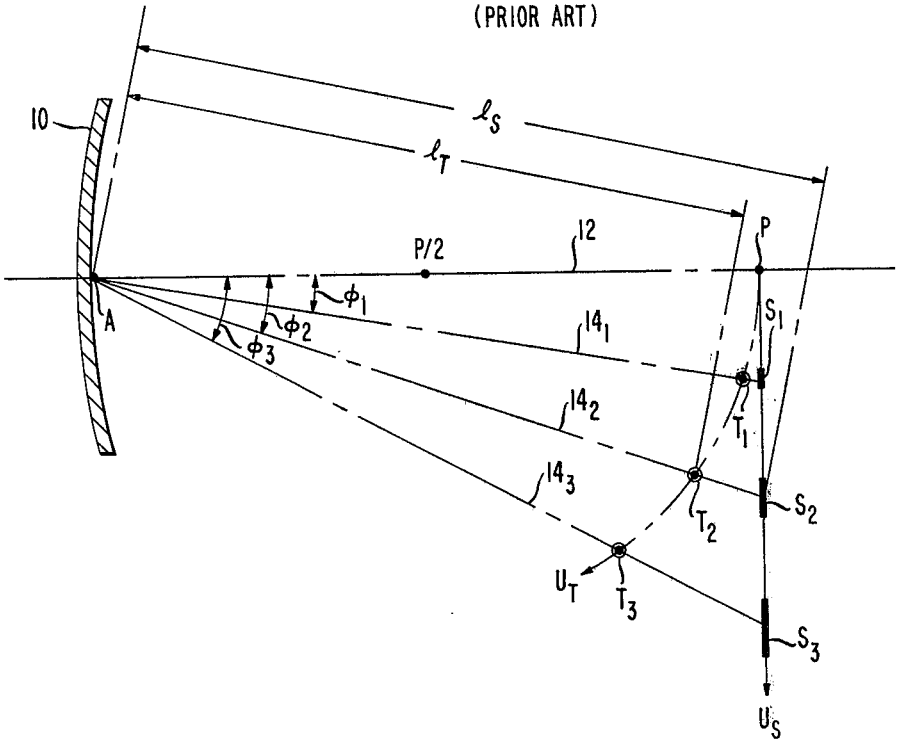
FIG. 2 (PRIOR ART)
FIG. 2 illustrates the location of the above-described sagittal and tangential focal lines as a function of the off-axis angle Φ.

In accordance with the present invention, the aberration of coma is compensated by correctly disposing the subreflector surface employed in the system with respect to the location of the sagittal and tangential focal regions of the main reflector. Therefore, to correct for coma aberration present in a wide-field-of-view system, as will be discussed hereinbelow, the locations of the S and T focal regions are analyzed as a function of the off-axis angle Φ. If the locations of the T and S focal regions are determined for a wide variety of off-axis angles, the centers of their focal regions form a curved and plane surface, respectively, as shown in FIG. 2. As the obliquity of the off-axis beam decreases and it approaches the axis, the region images not only come closer together as they approach the paraxial focal point P, but they diminish in size. The amount of coma for an off-axis beam is directly proportional to the off-axis angle associated with the given beam, whereas the amount of astigmatism is proportional to the square of the off-axis angle.

As stated hereinabove, the location of the sagittal and tangential focal regions, denoted S and T, respectively, are a function of the off-axis angle Φ. These positions can be approximately determined by employing the following equations:

$$(1/l_T)=(2/r\cos\Phi)$$

$$(1/l_S)=(2\cos\Phi/r) \qquad (1)$$

where $l_S$ and $l_T$ are the distances from point A of reflector 10 illustrated in FIG. 2 to the positions of the centers of the sagittal and tangential focal regions, respectively. The parameter r is defined as the radius of curvature of reflector 10, and the angle Φ measures the obliquity of, in this example, beams $\mathbf{14}_1$, $\mathbf{14}_2$, or $\mathbf{14}_3$, striking reflector 10, where beams $\mathbf{14}_1$, $\mathbf{14}_2$ and $\mathbf{14}_3$ are illustrated by their respective chief rays. It must be understood, however, that the above equations are related to a spherical reflecting surface 10, rather than a paraboloidal reflecting surface as is employed in most antenna arrangements. Thus, the above equations which were derived in relation to a spherical surface, serve merely as a basis for approximation.

The relationship between three exemplary off-axis angles, $\Phi_1$, $\Phi_2$ and $\Phi_3$ associated with the above-mentioned beams $\mathbf{14}_1$, $\mathbf{14}_2$ and $\mathbf{14}_3$, respectively, and the positions of the sagittal and tangential focal regions associated therewith are illustrated in FIG. 2, where only the chief ray of each beam is illustrated to provide a clearer understanding of the present invention. As the off-axis angle increases from $\Phi_1$ to $\Phi_2$ to $\Phi_3$, the associated focal regions S and T increase in size and move further apart. As can be seen by reference to FIG. 2, the sagittal focal region moves in a linear direction along $U_S$ as the off-axis angle increases, where, of the three exemplary angles, the smallest off-axis angle $\Phi_1$ is associated with the smallest sagittal focal region $S_1$ and the largest off-axis angle $\Phi_3$ is associated with the largest sagittal focal region $S_3$. Unlike the straight-line movement of the sagittal focal line, the tangential focal region moves in a curvilinear direction along $U_T$ as the off-axis angle increases. Like the sagittal focal region, the tangential focal region increases in size as the off-axis angle increases. For example, the smallest off-axis angle $\Phi_1$ is associated with the smallest focal region $T_1$ and the largest off-axis angle $\Phi_3$ is associated with the largest focal region $T_3$.

Figure 3:
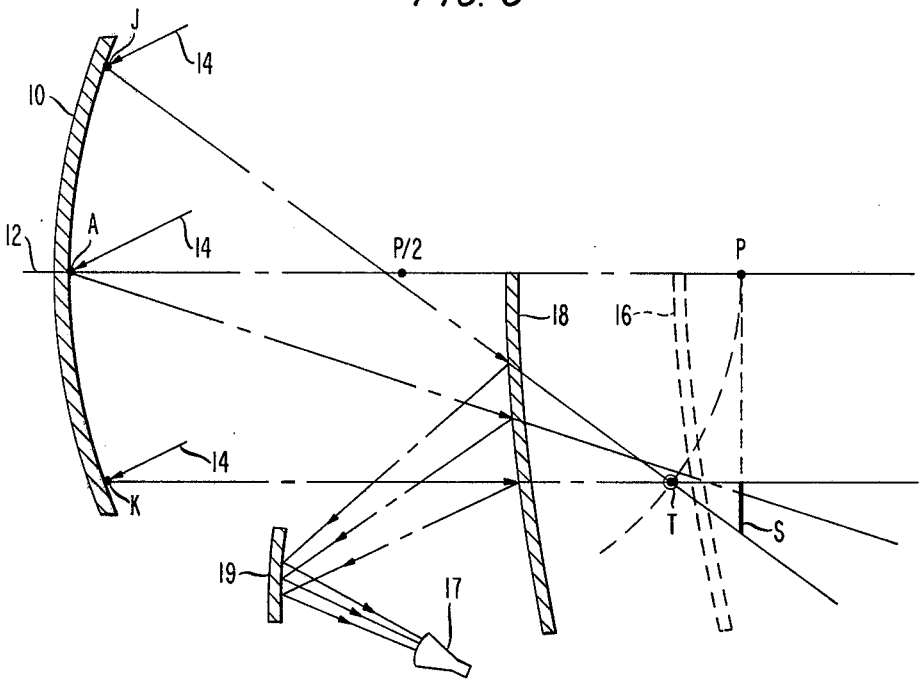
FIG. 3 is a top view of an offset Cassegrainian antenna arrangement showing a single beam formed in accordance with the present invention.

A top view of an off-set Cassegrainian antenna arrangement showing a single beam formed in accordance with the present invention is illustrated in FIG. 3. A Cassegrainian arrangement may be characterized by the hyperbolic shape of the subreflector employed, where in accordance with the mathematical properties of the hyperbola, the subreflector will maintain the focusing properties of the wavefront incident thereon. That is, a highly convergent wavefront will remain mildly convergent upon reflecting from the subreflector and likewise, a divergent wavefront will remain divergent upon reflection from the subreflector. In the specific example illustrated in FIG. 3, a paraboloidal main reflector 10 including a boresight axis 12 intercepts a plurality of parallel rays forming beam 14 which strike main reflector 10 at an angle Φ off boresight axis 12. The S and T focal regions discussed hereinabove in association with FIGS. 1 and 2 are illustrated in FIG. 3, where as the incident angle, Φ, of the beam impinging the surface of main reflector 10 increases from 0 degrees, the focal regions move from the paraxial focus P along the paths shown. For the illustrated angle Φ, the T focal region is located between main reflector 10 and a prior art located subreflector 16. Therefore, the tangential rays of beam 14 converge upon reflection from main reflector 10, focus toward region T, and diverge as they approach prior art located subreflector 16. In accordance with the above-described properties of a Cassegrainian antenna arrangement, the divergent beam incident on subreflector 16 will also be divergent upon reflection therefrom. Such divergence corresponds to an increase in coma, rather than the well-known decrease in coma normally associated with a Cassegrainian antenna. Therefore, in accordance with the present invention, an alternative hyperboloidal subreflector 18 is employed instead of subreflector 16, where subreflector 18 is positioned between main reflector 10 and the location of the T focal region. The tangential rays of beam 14 will therefore strike subreflector 18 as they are converging towards the T focal region, and therefore, since the tangential rays impinging the hyperbolic surface of subreflector 18 are convergent, and the subreflector surface is somewhat less divergent, the rays converge mildly upon reflection therefrom. As can be seen by reference to FIG. 3, the sagittal focal region S also remains behind subreflector 18 in this arrangement, and must do so in accordance with the principles of the present invention. Therefore, the mild convergence associated with the disposition of subreflector 18 in accordance with the present invention, will decrease the coma present at the feed arrangement of the antenna system.

However, the beam reflected from subreflector 18, although now compensated for coma and mildly convergent in form, is still astigmatic. Therefore, a feed arrangement, for example such as that disclosed in the above-cited Gans reference, may be employed to compensate for astigmatism. An exemplary feed 17 including a doubly curved launcher reflector 19, in accordance with Gans, is capable of correcting the astigmatism and is included in the antenna arrangement illustrated in FIG. 3. Therefore, the inclusion of the prior art astigmatic feed, in conjunction with the coma-correcting subreflector surface disclosed in the present invention, will allow an off-set Cassegrainian arrangement to transmit or receive beams as far off-axis as, for example but not limited to, 25 degrees with a reduction of both coma and astigmatism.

Figure 4:
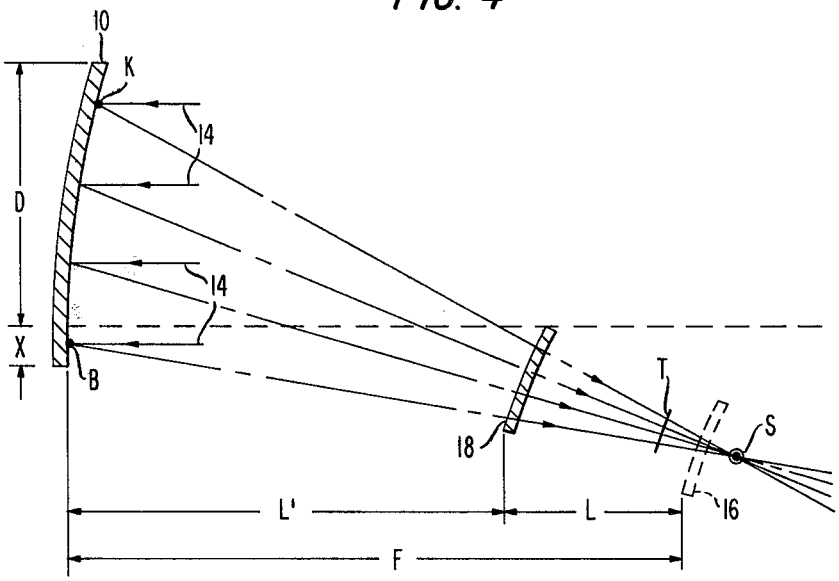
FIG. 4 is a partial side cross-sectional view of the offset Cassegrainian antenna arrangement of FIG. 3.

A side view of the arrangement of the present invention discussed hereinabove in association with FIG. 3 is shown in FIG. 4. In accordance with the present invention, an offset Cassegrainian antenna arrangement which has a focal-length to diameter ratio (F/D) of, for example, 2, and a subreflector magnification ($M=L'/L$) of, for example, 2, possesses the geometric properties necessary to locate the S and T focal regions such that they are both located behind the reflecting surface of subreflector 18, for an off-axis angle, $\Phi$, as large as, for example, 25 degrees. However, the relatively small magnification factor M associated with the present invention necessitates the use of a subreflector of larger proportions than those of prior Cassegrainian arrangements. Therefore, in order to avoid the blockage problem associated with the implementation of a larger subreflector, main reflector 10 can be elevated a distance x to remain offset from subreflector 18. It must be understood, however, that the specific values of F/D and M discussed hereinabove are for illustrative purposes only, since both variables may be adjusted accordingly in relation to the field-of-view and hence maximum off-axis angle $\Phi$ necessary for the particular implementation of the present invention.

The Cassegrainian arrangement illustrated in FIGS. 3 and 4 includes only a single parallel ray beam 14. However, the present invention may be, and in most cases would be, employed in association with a plurality of such beams, each intercepting main reflector 10 at a unique off-axis angle. Hence, relocation of the subreflector in accordance with the present invention allows the offset Cassegrainian arrangement to accommodate a plurality of beams intercepting the main reflector over a wide angular range. One such arrangement is illustrated in FIG. 5, which includes a top view of an exemplary off-set Cassegrainian arrangement of the present invention employing three separate and distinct beams, where only the chief ray of each beam is shown to avoid confusion and lead to a clearer understanding of the present invention.

Figure 5:
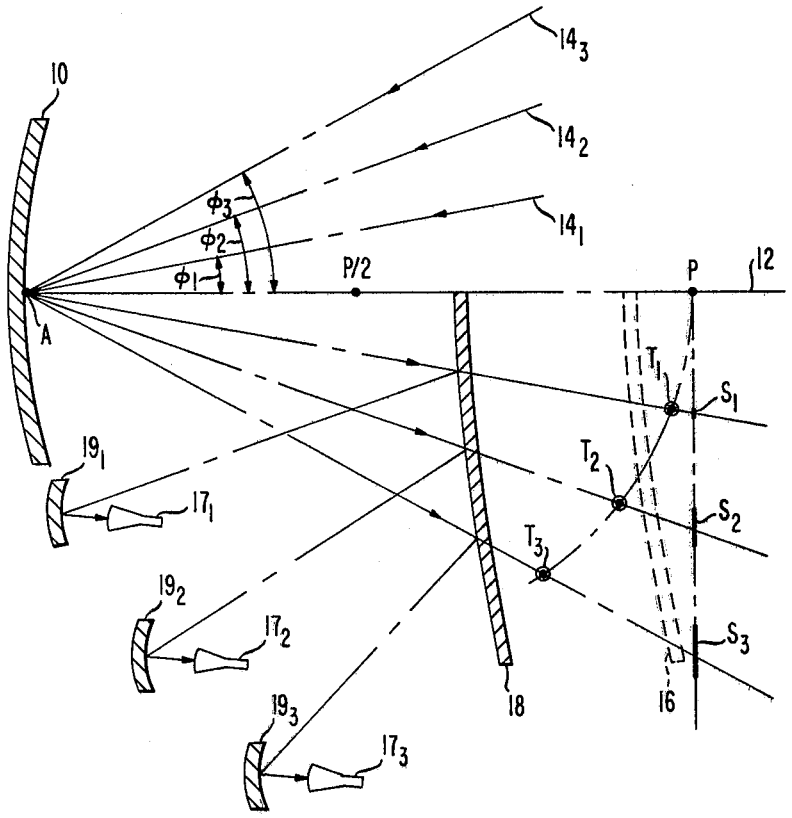
FIG. 5 is a top view of an offset Cassegrainian antenna arrangement showing multibeams formed in accordance with the present invention.

As can be seen by reference to FIG. 5, three distinct beams $\mathbf{14}_1$, $\mathbf{14}_2$, $\mathbf{14}_3$, as illustrated by their respective chief rays, intercept main reflector 10 at off-axis angles $\Phi_1$, $\Phi_2$ and $\Phi_3$, respectively. Associated with each beam is a separate pair of tangential and sagittal focal regions, for example, $T_1$ and $S_1$ are associated with beam $\mathbf{14}_1$, and $T_2$ and $S_2$ are associated with beam $\mathbf{14}_2$ and $T_3$ and $S_3$ are associated with beam $\mathbf{14}_3$. However, the center of each focal region associated with a particular off-axis beam, in accordance with the principles of coma aberration discussed hereinbefore in association with FIG. 1, is offset from the illustrated chief ray of the beam, where the amount of offset and hence, the degree of coma aberration, increases as the off-axis beam angle increases. In particular, focal regions $T_2$ and $S_2$ associated with off-axis angle $\Phi_2$ are offset a greater distance from the chief ray of beam $\mathbf{14}_2$ than $T_1$ and $S_1$ are in relation to beam $\mathbf{14}_1$ since $\Phi_1$ is less than $\Phi_2$, and, therefore, beam $\mathbf{14}_2$ includes a larger coma effect than beam $\mathbf{14}_1$. In a like manner, beam $\mathbf{14}_3$, which intercepts main reflector 10 at an off-axis angle $\Phi_3$ greater than either $\Phi_2$ or $\Phi_1$, includes a greater coma effect than beams $\mathbf{14}_1$ and $\mathbf{14}_2$. Consequently, focal regions $T_3$ and $S_3$ associated with beam $\mathbf{14}_3$ are offset further than the corresponding regions of beams $\mathbf{14}_1$ and $\mathbf{14}_2$.

In FIG. 5, the tangential focal region associated with at least one of the separate beams either intersects or is located in front of a prior art located subreflector 16. Therefore, in accordance with the principles of the present invention as discussed hereinabove in association with FIGS. 3 and 4, subreflector 18 is employed instead of prior art located subreflector 16, where subreflector 18 is positioned in relation to main reflector 10 in a manner whereby every focal region is located behind the reflecting surface of subreflector 18, thereby reducing the degree of coma aberration present at the feed arrangement for each beam.

As with the single beam arrangement discussed hereinabove in association with FIGS. 3 and 4, each beam in the multibeam arrangement of FIG. 5 remains astigmatic upon reflection from subreflector 18, and therefore, in a like manner, an astigmatic feed arrangement such as the above-cited Gans arrangement, may be employed in association with each beam. Specifically, feedhorn $\mathbf{17}_1$, and doubly curved reflector $\mathbf{19}_1$, may be employed to transmit or receive beam $\mathbf{14}_1$, feedhorn $\mathbf{17}_2$ and doubly curved reflector $\mathbf{19}_2$ may be employed to transmit or receive beam $\mathbf{14}_2$, and feedhorn $\mathbf{17}_3$ and doubly curved reflector $\mathbf{19}_3$ may be employed to transmit or receive beam $\mathbf{14}_3$.

It is to be understood, however, that the above-described arrangement including three off-axis beams is illustrative only and not for purposes of limitation, since a significantly larger plurality of off-axis beams may be employed and still fall within the spirit and scope of the present invention.

An alternative to the Cassegrainian antenna arrangement is the Gregorian antenna arrangement. In this case, the subreflector employed is a section of an ellipsoidal surface which, in contrast to the above-described hyperboloidal subreflector of the Cassegrainian arrangement, will invert the focusing properties of the beam striking the ellipsoidal surface thereof. That is, a strongly divergent beam incident on the ellipsoidal surface will become mildly convergent upon reflection, as needed to reduce coma. Such an arrangement also allows the feed for each beam to be located a reasonable distance from the ellipsoid. A top view of an exemplary Gregorian offset antenna arrangement showing a single beam formed in accordance with the present invention is illustrated in FIG. 6.

Figure 6:
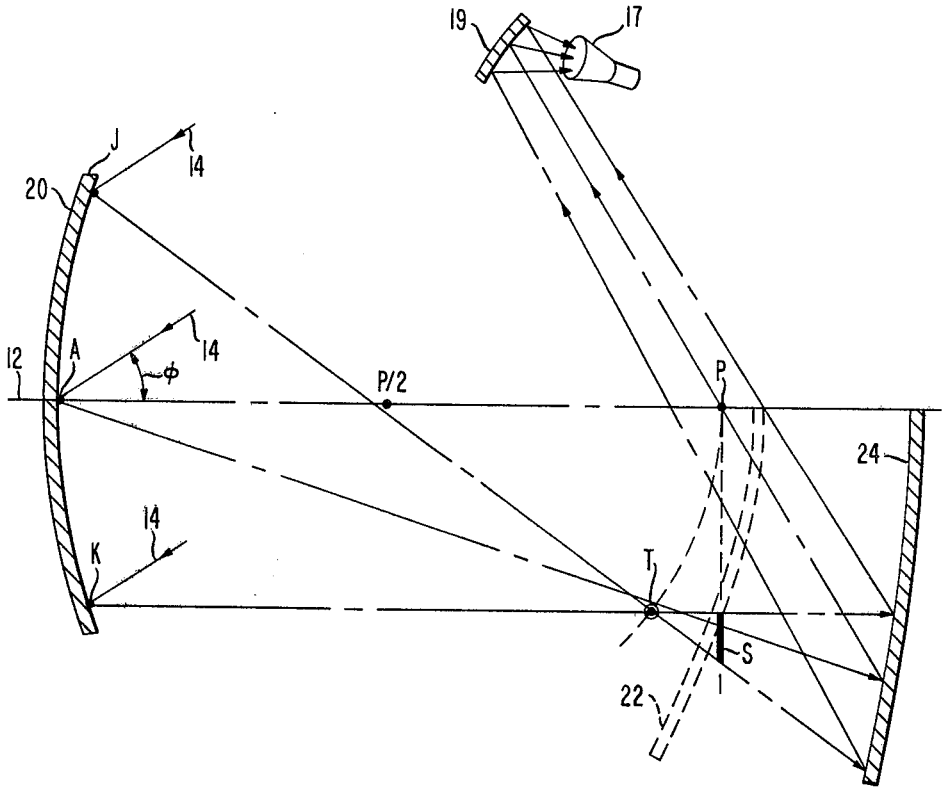
FIG. 6 is a top view of an offset Gregorian antenna arrangement showing a single beam formed in accordance with the present invention.

As with the above-described Cassegrainian antenna arrangement, the S and T focal regions associated with the Gregorian antenna arrangement are located as indicated in FIG. 6 as a function of the off-axis angle $\Phi$. As $\Phi$ approaches, for example, 25 degrees, the S focal region will intersect and move behind the reflecting surface of a prior art located subreflector 22, as can be seen by reference to FIG. 6. An off-axis beam 14, in accordance with the above-described properties of astigmatism and coma illustrated in FIG. 1, will converge upon reflection from a main reflector 20 to focus in the tangential focal region denoted T and the sagittal focal region denoted S. Since the T focal region is located between main reflector 20 and prior art located subreflector 22, tangential rays of beam 14 will focus toward T and will begin to diverge as they approach prior art subreflector 22. In contrast, since the S focal region is located behind prior art located subreflector 22, sagittal rays of beam 14 will converge towards this focal region and thus will be convergent in form as they strike the surface of subreflector 22. Therefore, in accordance with the ellipsoidal properties of prior art located subreflector 22, sagittal rays of beam 14 will be extremely convergent upon reflection, where such convergence increases, rather than decreases, coma. Furthermore, the feed will be impractically close to the ellipsoidal surface.

Therefore, in accordance with the present invention, an alternative subreflector 24 of ellipsoidal form is employed in place of prior art located subreflector 22, where subreflector 24 is located, in this example, at a further distance from main reflector 20 than subreflector 22 such that both the S and the T focal regions are located between main reflector 20 and subreflector 24. Therefore, beam 14 will focus in both the S and T focal regions before impinging subreflector 24 and hence will be divergent in form as it strikes the surface thereof. Therefore, in accordance with the geometric properties of ellipsoidal subreflector 24, the beam will become mildly convergent upon reflection, as needed to cancel coma in the feed region. Therefore, the coma present at the feed arrangement will be significantly reduced, and the feed can be located at practical distance from the subreflector, due to the disposition of subreflector 24 in accordance with the present invention.

However, the beam reflected from subreflector 24, although now mildly convergent in form, is still astigmatic. Therefore, a feed arrangement, for example, such as that disclosed in the above-cited Gans reference may be employed to compensate for astigmatism. An exemplary feed 17 including a doubly curved launcher reflector 19, formed in accordance with Gans is included in the antenna system illustrated in FIG. 6. As a result, the inclusion of the prior art astigmatic feed, in conjunction with the coma-correcting subreflector disclosed in the present invention, will allow an offset Gregorian arrangement to transmit or receive beams as far off-axis as, for example but not limited to, 25 degrees with a reduction of both coma and astigmatism.

The Gregorian arrangement illustrated in FIG. 6 includes only a single parallel ray beam 14. However, the present invention may be, and in most cases would be, employed in association with a plurality of such beams, each intercepting main reflector 20 at a unique off-axis angle. Hence, relocation of the subreflector in accordance with the present invention, allows the offset Gregorian arrangement to accommodate a plurality of beams intercepting the main reflector over a wide angular range. A top view of an exemplary offset Gregorian arrangement of the present invention employing three separate and distinct beams is illustrated in FIG. 7, where only the chief ray of each beam is shown to avoid confusion and lead to a clearer understanding of the present invention.

Figure 7:
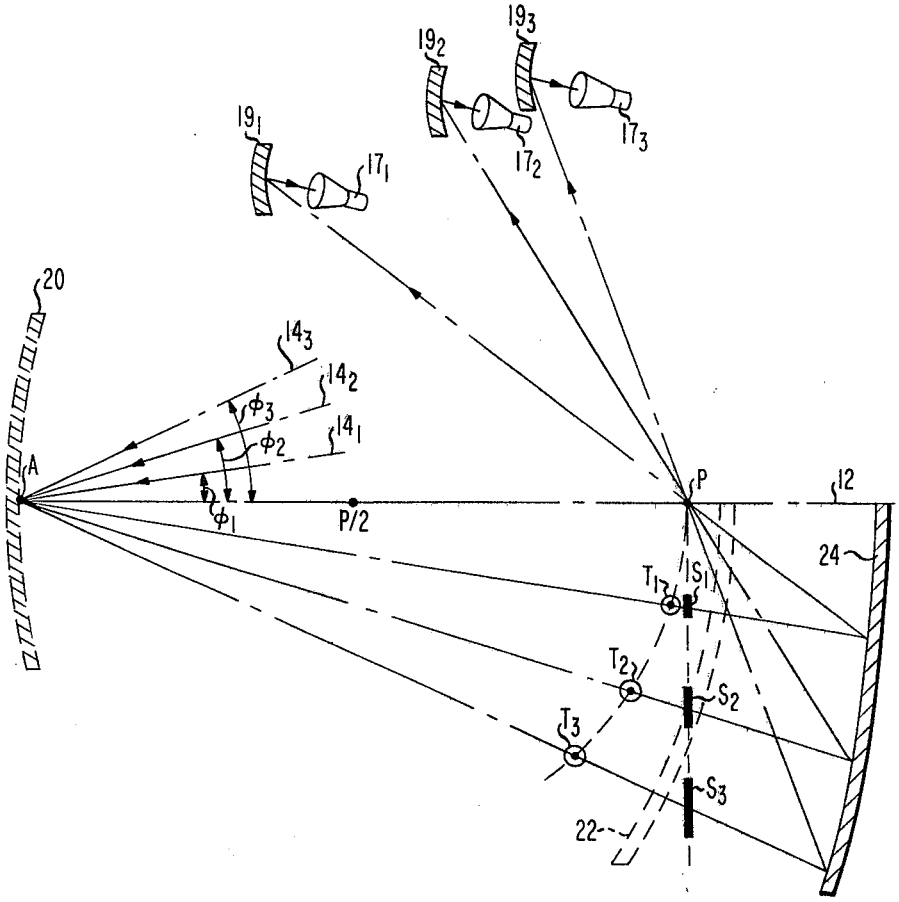
FIG. 7 is a top view of an offset Gregorian antenna arrangement showing multibeams formed in accordance with the present invention.

As can be seen by reference to FIG. 7, three distinct beams $\mathbf{14}_1$, $\mathbf{14}_2$, $\mathbf{14}_3$, as illustrated by their respective chief rays, intercept main reflector 20 at off-axis angles $\Phi_1$, $\Phi_2$ and $\Phi_3$, respectively. Associated with each beam is a separate pair of tangential and sagittal focal regions, for example, $T_1$ and $S_1$ are associated with beam $\mathbf{14}_1$, $T_2$ and $S_2$ are associated with beam $\mathbf{14}_2$, and $T_3$ and $S_3$ are associated with beam $\mathbf{14}_3$. However, the center of each focal region associated with a particular off-axis beam, in accordance with the principles of coma aberration discussed hereinbefore in association with FIG. 1 is offset from the illustrated chief ray of the beam, where the amount of offset and hence, the degree of coma aberration, increases as the off-axis beam angle increases. In particular, focal regions $T_2$ and $S_2$ associated with off-axis angle $\Phi_2$ are offset a greater distance from the chief ray of beam $\mathbf{14}_2$ than $T_1$ and $S_1$ are in relation to beam $\mathbf{14}_1$ since $\Phi_1$ is less than $\Phi_2$, and, therefore, beam $\mathbf{14}_2$ includes a larger coma effect than beam $\mathbf{14}_1$. In a like manner, beam $\mathbf{14}_3$, which intercepts main reflector 20 at an off-axis angle $\Phi_3$ greater than either $\Phi_2$ or $\Phi_1$, includes a greater coma effect than beams $\mathbf{14}_1$ or $\mathbf{14}_2$. Consequently, focal regions $T_3$ and $S_3$ associated with beam $\mathbf{14}_3$ are offset further than the corresponding regions of beams $\mathbf{14}_1$ and $\mathbf{14}_2$.

In FIG. 7, the sagittal focal regions associated with at least one of the separate beams either intersects or is located behind a prior art located subreflector 22. Therefore, in accordance with the principles of the present invention as discussed hereinabove in association with FIG. 6, subreflector 24 is employed in place of prior art located subreflector 22, where subreflector 24 is positioned in relation to main reflector 20 so that every focal region associated with multiple beams impinging reflector 20 over a wide angular range is located in front of the reflecting surface of subreflector 24, thereby reducing the degree of coma aberration present at the feed arrangement for each beam.

As with the single beam discussed hereinabove in association with FIG. 6, each beam in the multibeam arrangement of FIG. 7 remains astigmatic upon reflection from subreflector 24, and therefore, an astigmatic feed arrangement such as the above-cited Gans arrangement, may be employed in association with each beam. Specifically, feedhorn $17_1$ and doubly curved reflector $19_1$ may be employed to transmit or receive beam $14_1$, feedhorn $17_2$ and doubly curved reflector $19_2$ may be employed to transmit or receive beam $14_2$, and feedhorn $17_3$ and doubly curved reflector $19_3$ may be employed to transmit or receive beam $14_3$.

It is to be understood, however, that the above-described arrangement including three off-axis beams is illustrative only and not for purposes of limitation, since a significantly larger plurality of off-axis beams may be employed and still fall within the spirit and scope of the present invention.

What is claimed is:

1. A wide-field-of-view antenna system capable of transmitting or receiving a plurality of beams (14) comprising in combination:

a main focusing reflector (10,20) including a reflecting surface, a boresight axis (12) and a paraxial focus (P), said reflector producing a tangential focal region and a sagittal focal region associated with each beam of said plurality of beams;

a feed arrangement (17,19) disposed to permit the transmitting or receiving of each beam of said plurality of beams along a separate associated predetermined direction (Φ) with respect to said boresight axis over a wide-field-of-view; and a subreflector (18,24) including a reflecting surface capable of directing said plurality of beams between said main reflector and said feed arrangement;

characterized in that the subreflector is located in relation to the main reflector such that both the plurality of tangential focal regions and the plurality of sagittal focal regions remain on the same side of said subreflector as the paraxial focus and do not intersect the reflecting surface of said subreflector for any predetermined transmitting or receiving direction.

2. A wide-field-of-view antenna system in accordance with claim 1 characterized in that the subreflector (24) includes an ellipsiodal reflecting surface, said subreflector positioned in relation to the main reflector such that both the plurality of tangential focal regions and the plurality of sagittal focal regions are located between and do not intersect the reflecting surfaces of said main reflector and said subreflector.

3. A wide-field-of-view antenna system in accordance with claim 1 characterized in that the subreflector (18) includes a hyperboloidal reflecting surface, said subreflector positioned in relation to the main reflector such that both the plurality of tangential focal regions and the plurality of sagittal focal regions are located behind and do not intersect the reflecting surface of said subreflector.

* * * * *